US005809585A

United States Patent [19]

Farshad

[11] Patent Number: 5,809,585

[45] Date of Patent: Sep. 22, 1998

[54] BIDET TOILET SYSTEM

[76] Inventor: Fred F. Farshad, 405 Shelly Dr., Lafayette, La. 70503

[21] Appl. No.: 700,808

[22] Filed: Aug. 21, 1996

[51] Int. Cl.[6] ..... A47K 3/22

[52] U.S. Cl. ..... 4/443; 4/448; 4/420.4

[58] Field of Search ..... 4/443, 448, 420.2, 4/420.4, 445, 449

[56] References Cited

U.S. PATENT DOCUMENTS

| | | | |
|---|---|---|---|
| 2,364,491 | 12/1944 | Triadou | 4/420.4 |
| 3,577,567 | 5/1971 | Wintercorn | 4/445 |
| 4,596,058 | 6/1986 | Nourbakhsh | 4/443 |
| 4,924,534 | 5/1990 | Basile | 4/447 |
| 5,023,961 | 6/1991 | Alonso | 4/443 |
| 5,295,274 | 3/1994 | Daniels et al. | 4/443 |

*Primary Examiner*—David J. Walczak
*Attorney, Agent, or Firm*—Domingue, Delaune & Waddell

[57] ABSTRACT

A sanitation device used for a person's hygiene is mounted to a wall adjacent a commode. Generally, the sanitation device comprises a commode adapted for disposing contents within a bowl, and a drain member, operatively associated with the commode, for draining the contents of the bowl. A sanitary water delivery member, operatively associated with the commode, is disclosed for cleaning the person's genital area with a stream water is also provided. In the preferred embodiment, the sanitary water delivery member includes a discharge nozzle; and, a tube having a first end and a second end, with the first end being connected to the discharge nozzle. The second end of the tube will be operatively connected to a water supply for supply water to the tube.

3 Claims, 3 Drawing Sheets

BIDET TOILET SYSTEM

BACKGROUND OF THE INVENTION

This invention relates to a novel sanitation device for a person's hygiene. More particularly, but not by way of limitation, this invention relates to a novel bidet toilet system for personal hygiene.

Modern day bathrooms generally contain a toilet system which is generally a disposal apparatus consisting of a hopper, fitted with a flushing device. The toilet systems make for efficient and sanitary disposal. Bidet systems are also known in the art, even though not nearly as numerous as the toilet system. The bidet systems generally comprises a basin like fixture designed to be straddled by the person for bathing the genitals and the posterior parts.

The bidet system offers the significant advantage of allowing the cleansing with a fresh stream of water. This is particularly beneficial if the person has certain health problems such as hemorrhoids. However, the bidet systems require having an adjacent toilet. Thus, the bidet system requires two basins and two drains.

The toilet systems presently used only require one basin and one drain. However, the toilet tissue required for cleansing may be abrasive and irritable. This is particularly true for those individuals with health problems such as hemorrhoids. For those individuals desiring a bidet, the installation of an additional bowl as well as installation of an additional drain makes the joining of the bidet system either impossible due to space limitations or too costly.

Thus, there is a need for a sanitation device that cleanse a person's posterior and genital with a gentle stream of water. There is also a need for such a sanitation device that can be fitted into a bathroom of limited space and without the necessity of having separate bowls and drains.

SUMMARY OF THE INVENTION

A sanitation device used for a person's hygiene is disclosed. Generally, the sanitation device comprises a commode means for disposing contents within a bowl, and a drain member, operatively associated with the commode means, for draining the contents of the bowl. A sanitary means, operatively associated with the commode means, for cleaning the person's genital area with a stream water is also provided.

In the preferred embodiment, the sanitary means includes a discharge nozzle; a tube having a first end and a second end, with the first end being connected to the discharge nozzle. The second end of the tube will be operatively connected to a water supply means for supply water to the tube. The tube of the sanitation device will be flexible and long enough so that the tube permits directed water flow to anal and genital areas of the person seated on the commode means.

In one embodiment, the water supply means contains a supply valve member adapted for controlling the quantity of water supplied to the tube. Further, the water supply means may also include a temperature valve member adapted for controlling the temperature of the water supplied to the tube.

Also disclosed is a bidet toilet system that includes a toilet having a bowl area fluidly connected to a drain. A water delivery device is housed adjacent to the toilet, with the water delivery device being controllable by a person seated on the toilet. In general, the water delivery device comprises: a water temperature control means for controlling water temperature; a hose having a first end and a second end, with the hose being connected at the first end to the water temperature control means and connected at the second end to a nozzle. In this bidet toilet system, the nozzle can be placed in the bowl area of the toilet while the person is seated on the toilet.

In one embodiment, the water temperature control means includes a standard pressure balanced mixing valve for desired temperature of the water. Further, the water temperature control means includes separate cold and hot water valves for individual control of water temperature and pressure. Further, the nozzle permits directed water flow to anal and genital areas of the person seated on the toilet.

An advantage of the present system includes having a personal hygiene station located on the wall next to the toilet. Another advantage is the system's tube is flexible so that the person may use the device while seated on the toilet. Yet another advantage is the person may have a pre-controlled temperature of water.

Another advantage includes having the person control the quantity of water delivered in the stream. Yet another advantage includes replacement of abrasive and irritable toilet tissue. Still further, the system herein disclosed will save users money since it replaces the toilet tissue.

Yet another advantage is that the system provides the same function as bidets at a fraction of the cost and much less space. Most bidets require a 4 foot by 4 foot space next to a wall and usually are installed next to a toilet. The invention herein disclosed is a controlled temperature water spray pipe which can be installed to the wall adjacent to the toilet under or next to the toilet tissue holder. The system will have water supply lines and delivery system without the need for separate drainage systems.

DESCRIPTION OF THE PREFERRED EMBODIMENTS

Figure 1:
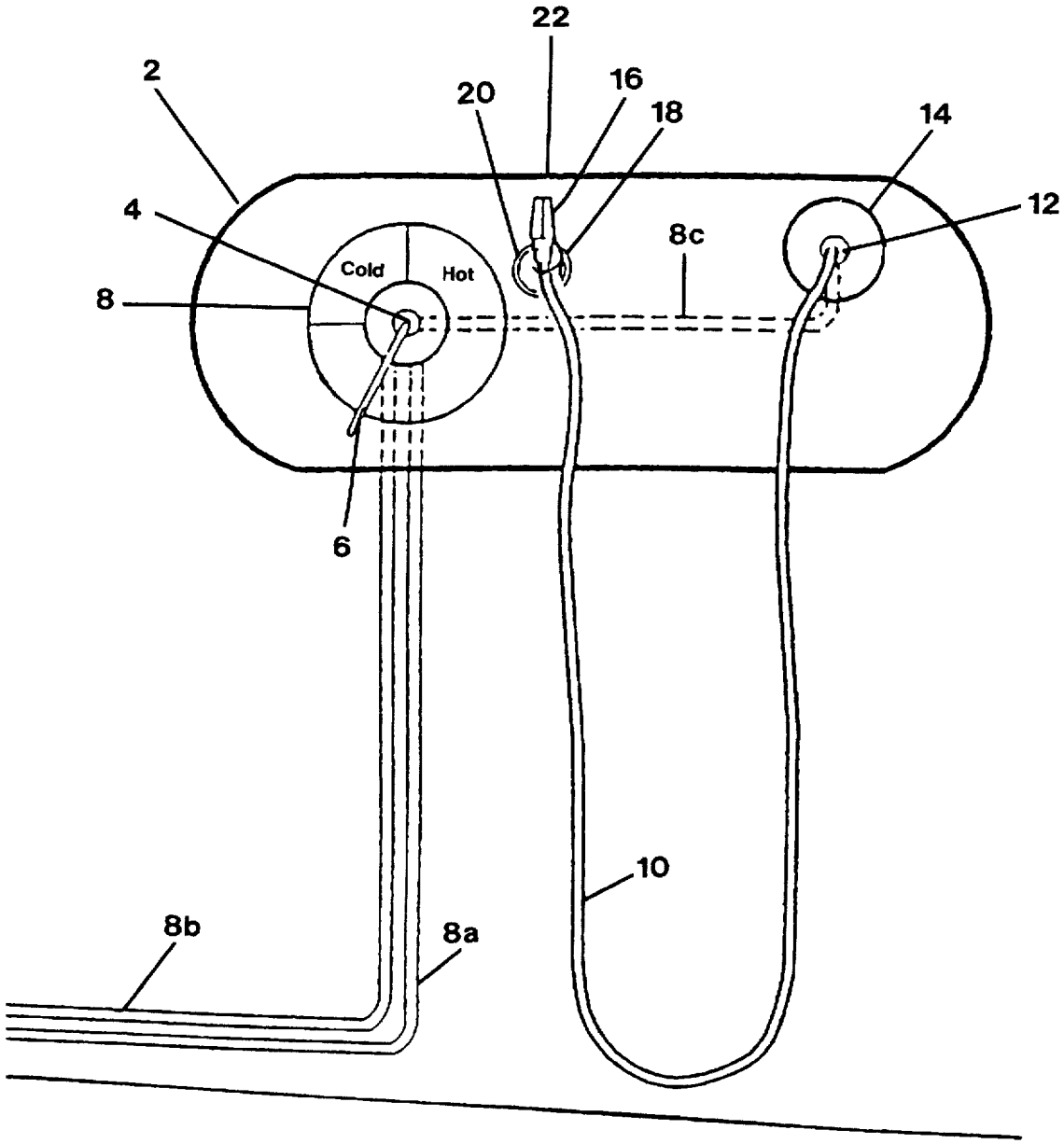
FIG. 1 is a schematic illustration of one embodiment of the water delivery system of the present invention.

Referring to FIG. 1, a schematic illustration of the water delivery system 2 (also referred to as a sanitary means for cleaning the person's genital area) is shown. As shown, the water delivery system 2 has a water supply means 4 for supplying the water to water delivery system 2 as will be more fully set out. The water supply means 4 has a supply valve member 6 adapted for controlling the quantity of water to the system 2, as well as a temperature valve member 8 operatively associated with the hot water line 8A, the room temperature water supply line 8B and the mixed temperature water line 8C.

The temperature valve member 8 is adapted for controlling the temperature of the water stream by mixing the amount of room temperature water with the hot water, with the temperature valve member 8 being well known in the art and commercially available from Kohler Inc. In fact, all of the plumbing devices used in accordance with the teachings of the present invention may be commercially purchased from Kohler.

The sanitary means 2 also includes the flexible tube 10 that will have one end attached to the elbow fitting 12 that in turn is connected to the chrome escutcheon 14 which substantially conceals the opening where the elbow fitting exits the cover plate 22. The elbow fitting allows for fluidly connecting the water supply to the tube 10.

The tube 10 will have connected thereto at the second end the nozzle 16 adapted for directing the stream of water produced from the tube during operation. The tube will also have connected thereto a hook 18 that can be used to attach to the eye member 20 so that the tube may be conventionally stored during non-use. The nozzle 16 may have a valve member thereon so that the operator may control water delivery during actual use. A type of valve member suitable is the type of valve member used with a hose and spray kit adapted with kitchen sinks. This type of valve member is commercially available from Plumb Pak Corporation under the trademark Plumb Pak.

The water delivery system 2 is operatively associated with the cover plate 22 which is attached to the wall of the rest room where the water delivery system will be mounted. The cover plate 22 covers the piping area of the water source and in particular the water supply means, supply valve member 6 and the temperature valve member 8. The cover plate 22 is mounted to the wall via the mounting screws (not shown).

Figure 2:
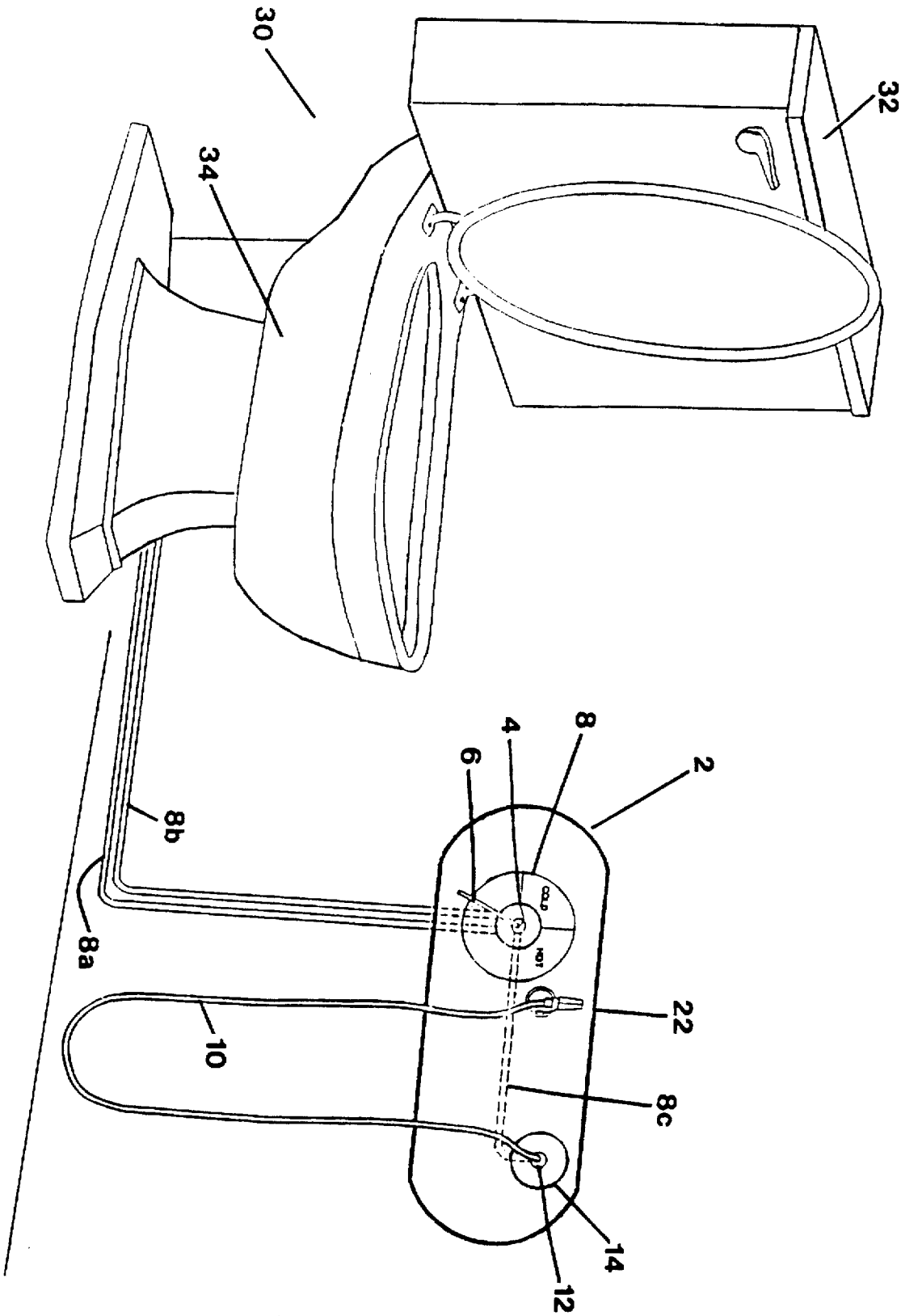
FIG. 2 is an illustrated view of the invention in a typical rest room.

Referring now to FIG. 2, the sanitary bidet toilet system will now be described. It should be noted that like numbers appearing in the various figures refer to like components. FIG. 2 depicts a standard toilet 30, also referred to as a commode. The toilet 30 is a disposal apparatus consisting of a hopper, fitted with a flushing device, used for urination and defecation. As is well known in the art, the reservoir 32 of the toilet is connected to a water supply. Also, the toilet 30 will have a bowl 34 that will in turn be connected to a drain for disposal of the bowl contents.

The water delivery device 2 is shown positioned adjacent to the toilet 30. As illustrated, the water delivery device 2 is separate from the toilet 30 and is mounted on the wall neighboring the tissue holder (not shown). In this position, the water delivery system, and in particular the water supply means 4, is within the reach of the person while the person is seated on the toilet.

The prior art bidet systems comprise a basin like fixture designed to be straddled for bathing the genitals and the posterior parts. Thus, the novel bidet toilet systems herein described allows the person to perform these types of personal hygienic functions, but eliminates the need for a separate basin fixture. Moreover, the novel bidet toilet system requires only one drain, and therefore, can be installed next to an existing toilet system. With the flexible tube 10, the person may easily maneuver the nozzle 16 to meet his or her needs.

Figure 3:
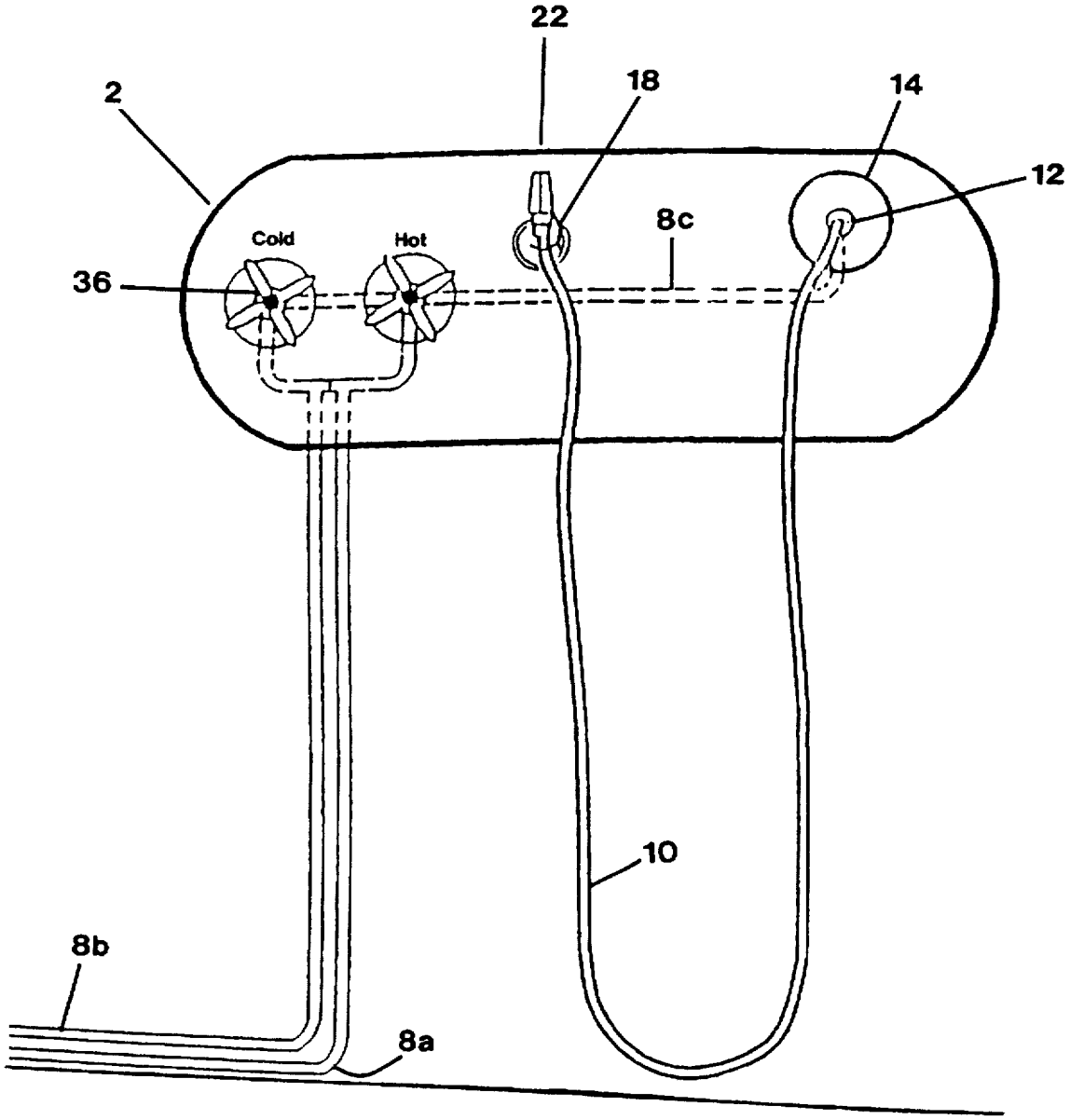
FIG. 3 is a schematic illustration of a second embodiment of the water delivery system of the present invention.

Referring now to FIG. 3, a schematic illustration of a second embodiment of the water delivery system 22 of the present invention is displayed. Thus, the operator may manually control the quantity of water as well as the temperature. The embodiment of FIG. 3 has a cold water valve 36 connected to the cold water line 8B and a hot water valve 38 connected to the hot water line 8A. Both valves 36, 38 are operatively associated with the line 8C that ultimately delivers water to the tube 10, as previously described. It should be noted that operator may wish to have only a room temperature water supply for delivery, which the invention herein disclosed may be adapted for such a situation.

Changes and modifications in the specifically described embodiments can be carried out without departing from the scope of the invention which is intended to be limited only by the scope of the appended claims.

I claim:

1. A sanitation device for a person's hygiene contained within a restroom having a wall, a ceiling and a floor wherein said wall contains an upstanding member having a first end and a second end, and wherein said first end of said wall is connected to said ceiling and said second end is connected to said floor, the sanitation device comprising:

commode means positioned in said restroom on said floor for disposing contents within a bowl;

drain member, operatively associated with said commode means, for draining the contents of said bowl;

sanitary means, operatively associated with said commode means and set within said wall of said restroom separate from said commode means, for cleaning the person's genital area with a stream water and wherein said sanitary means comprises: a cover plate, a discharge nozzle disposed on said cover plate; a tube having a first end and a second end, with said first end being connected to said discharge nozzle; and, water supply means, operatively connected to the second end, for supply the water to said tube and wherein said cover plate is mounted to said wall apart from said commode so that a splash of the contents of said bowl does not contaminate said sanitary means;

and wherein said water supply means comprises a supply valve member adapted for controlling the quantity of water supplied to said tube and a temperature valve member adapted for controlling the temperature of the water supplied to said tube so that the person can hold said sanitary means and control said water supply means at the same time.

2. The sanitation device of claim 1 wherein a length of said tube permits directed water flow to anal and genital areas of the person seated on said commode means.

3. A bidet toilet system contained within a restroom having a wall, a ceiling and a floor and wherein said wall contains an upstanding member having a first end and a second end, and wherein said first end of said wall is connected to said ceiling and said second end of said wall is connected to said floor, the bidet toilet system comprising:

a toilet disposed on said floor having a bowl area fluidly connected to a drain with said toilet having a fluid content; and, a water delivery device housed within said wall separate from said toilet, said water delivery device being controllable by a person seated on said toilet and wherein said water delivery device comprises: a cover plate mounted to said wall, a water temperature control means for controlling water temperature; a hose having a first end and a second end, and said hose being connected at the first end to said water temperature control means and connected at the second end of a nozzle so that said nozzle can be placed in the bowl area of said toilet, said nozzle adapted to deliver a water spray;

and wherein said water temperature control means includes a standard pressure balanced mixing valve for desired temperature of the water so that a person can control the water spray from said nozzle with a first hand and control said water valve with a second hand.

* * * * *